US005941176A

United States Patent [19]

Schultz et al.

[11] Patent Number: 5,941,176

[45] Date of Patent: Aug. 24, 1999

[54] DISPLAY SHELF

[76] Inventors: Steve P. Schultz, P.O. Box 161, Big Oak Flat, Calif. 95305; John Matthews, P.O. Box 161, Groveland, Calif. 95321

[21] Appl. No.: 09/078,628

[22] Filed: May 14, 1998

[51] Int. Cl.[6] ..... A47B 85/00

[52] U.S. Cl. ..... 108/23; 312/223.5

[58] Field of Search ..... 108/23, 50.02; 312/114, 223.5; 211/26, 88.01, 90.01

[56] References Cited

U.S. PATENT DOCUMENTS

| | | | |
|---|---|---|---|
| 2,018,024 | 10/1935 | Kress | 312/114 X |
| 2,920,244 | 1/1960 | Miksit et al. | 211/26 X |
| 3,640,389 | 2/1972 | Snyder | 108/108 X |
| 3,936,109 | 2/1976 | Richardson | 312/223.5 |
| 4,654,762 | 3/1987 | Laverick | 108/23 X |
| 4,920,895 | 5/1990 | Burke et al. | 211/88.01 X |
| 5,560,500 | 10/1996 | Wilcox | 211/88.01 |
| 5,806,689 | 9/1998 | Mays et al. | 211/90.01 X |

FOREIGN PATENT DOCUMENTS 234599 7/1961 Australia .

*Primary Examiner*—Peter M. Cuomo
*Assistant Examiner*—Karlena D. Schwing

[57] ABSTRACT

A new display shelf for displaying model cars thereon. The inventive device includes at least one shelf unit comprising a top panel and a pair of support panels. The top panel has upper and lower surfaces, top and bottom side edges, and a pair of end edges extending between the side edges of the top panel. The upper surface of the top panel has a number of elongate ridges upwardly extending therefrom with the length of each of the ridges extending between the end edges of the top panel. Each support panel is generally triangular and has top, bottom and back edges with the length of the top edge of the support panel extending at an acute angle to the length of the bottom edge of the support panel. The top edge of each of the support panels is coupled to the lower surface of the top panel. The back edge of each of the support panels has a mounting flange extending therefrom which is positioned adjacent the top edge of the top panel.

9 Claims, 2 Drawing Sheets

FIG. 1
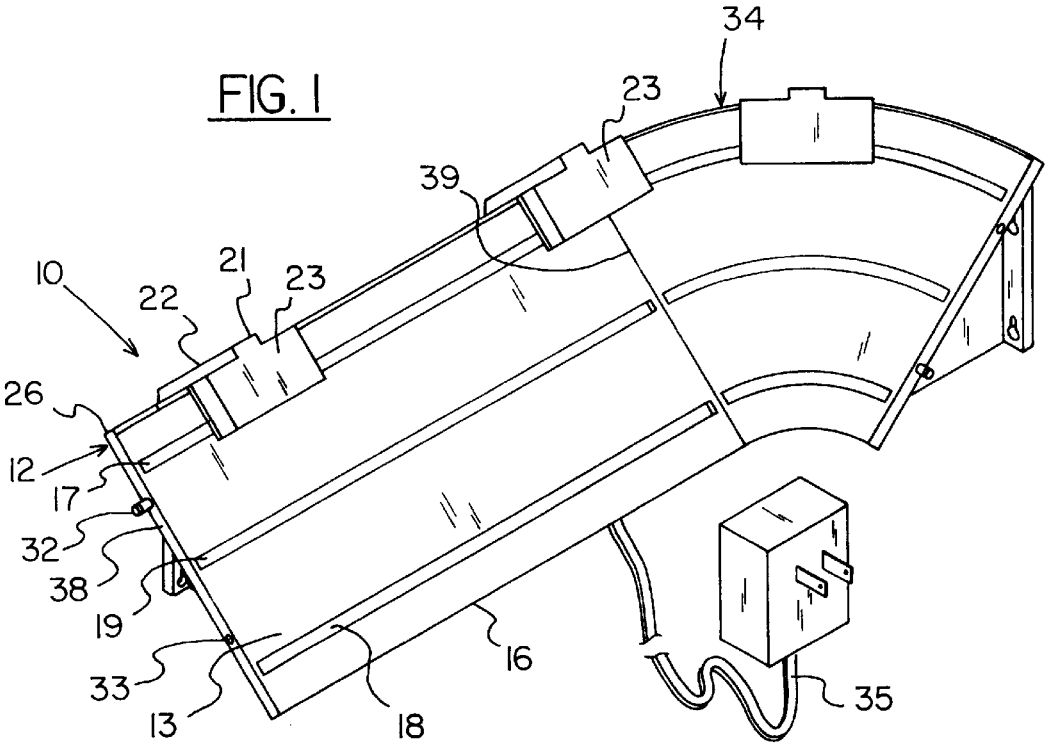
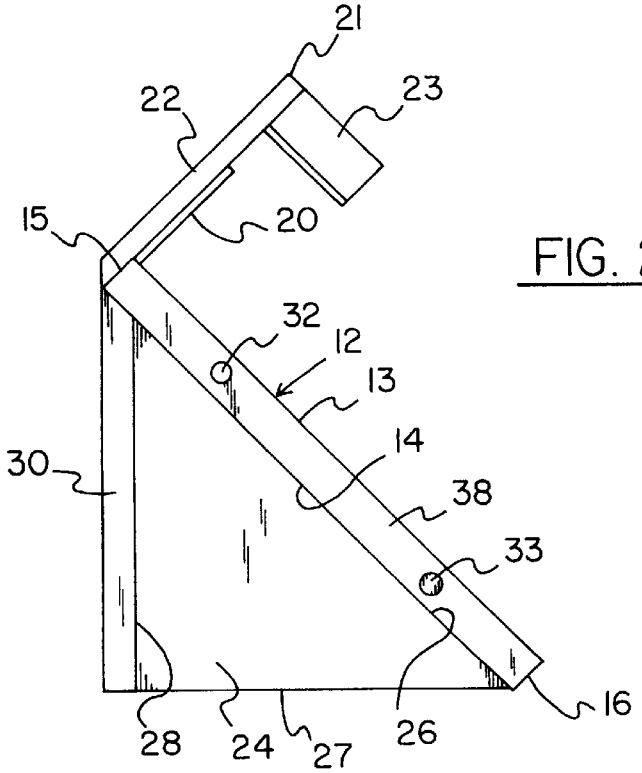
FIG. 2

DISPLAY SHELF

BACKGROUND OF THE INVENTION

1. Field of the Invention

The present invention relates to devices for displaying models and figurines and more particularly pertains to a new display shelf for displaying model cars thereon.

2. Description of the Prior Art

The use of devices for displaying models and figurines is known in the prior art. More specifically, devices for displaying models and figurines heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for displaying models and figurines include U.S. Pat. No. 5,097,771; U.S. Pat. No. 4,527,688; U.S. Pat. No. 5,031,780; U.S. Pat. No. 4,241,875; U.S. Pat. No. 3,138,261; and U.S. Pat. No. 2,000,808.

While these devices fulfill their respective, particular objectives and requirements, the aforementioned patents do not disclose a new display shelf. The inventive device includes at least one shelf unit comprising a top panel and a pair of support panels. The top panel has upper and lower surfaces, top and bottom side edges, and a pair of end edges extending between the side edges of the top panel. The upper surface of the top panel has a number of elongate ridges upwardly extending therefrom with the length of each of the ridges extending between the end edges of the top panel. Each support panel is generally triangular and has top, bottom and back edges with the length of the top edge of the support panel extending at an acute angle to the length of the bottom edge of the support panel. The top edge of each of the support panels is coupled to the lower surface of the top panel. The back edge of each of the support panels has a mounting flange extending therefrom which is positioned adjacent the top edge of the top panel.

In these respects, the display shelf according to the present invention substantially departs from the conventional concepts and designs of the prior art, and in so doing provides an apparatus primarily developed for the purpose of displaying model cars thereon.

SUMMARY OF THE INVENTION

In view of the foregoing disadvantages inherent in the known types of devices for displaying models and figurines now present in the prior art, the present invention provides a new display shelf construction wherein the same can be utilized for displaying model cars thereon.

The general purpose of the present invention, which will be described subsequently in greater detail, is to provide a new display shelf apparatus and method which has many of the advantages of the devices for displaying models and figurines mentioned heretofore and many novel features that result in a new display shelf which is not anticipated, rendered obvious, suggested, or even implied by any of the prior art devices for displaying models and figurines, either alone or in any combination thereof.

To attain this, the present invention generally comprises at least one shelf unit comprising a top panel and a pair of support panels. The top panel has upper and lower surfaces, top and bottom side edges, and a pair of end edges extending between the side edges of the top panel. The upper surface of the top panel has a number of elongate ridges upwardly extending therefrom with the length of each of the ridges extending between the end edges of the top panel. Each support panel is generally triangular and has top, bottom and back edges with the length of the top edge of the support panel extending at an acute angle to the length of the bottom edge of the support panel. The top edge of each of the support panels is coupled to the lower surface of the top panel. The back edge of each of the support panels has a mounting flange extending therefrom which is positioned adjacent the top edge of the top panel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new display shelf apparatus and method which has many of the advantages of the devices for displaying models and figurines mentioned heretofore and many novel features that result in a new display shelf which is not anticipated, rendered obvious, suggested, or even implied by any of the prior art devices for displaying models and figurines, either alone or in any combination thereof.

It is another object of the present invention to provide a new display shelf which may be easily and efficiently manufactured and marketed.

It is a further object of the present invention to provide a new display shelf which is of a durable and reliable construction.

An even further object of the present invention is to provide a new display shelf which is susceptible of a low cost of manufacture with regard to both materials and labor, and which accordingly is then susceptible of low prices of sale to the consuming public, thereby making such display shelf economically available to the buying public.

Still yet another object of the present invention is to provide a new display shelf which provides in the apparatuses and methods of the prior art some of the advantages thereof, while simultaneously overcoming some of the disadvantages normally associated therewith.

Still another object of the present invention is to provide a new display shelf for displaying model cars thereon.

Yet another object of the present invention is to provide a new display shelf which includes at least one shelf unit comprising a top panel and a pair of support panels. The top panel has upper and lower surfaces, top and bottom side edges, and a pair of end edges extending between the side edges of the top panel. The upper surface of the top panel has a number of elongate ridges upwardly extending therefrom with the length of each of the ridges extending between the end edges of the top panel. Each support panel is generally triangular and has top, bottom and back edges with the length of the top edge of the support panel extending at an acute angle to the length of the bottom edge of the support panel. The top edge of each of the support panels is coupled to the lower surface of the top panel. The back edge of each of the support panels has a mounting flange extending therefrom which is positioned adjacent the top edge of the top panel.

Still yet another object of the present invention is to provide a new display shelf that may be mounted to a wall structure.

Even still another object of the present invention is to provide a new display shelf that resembles a race track so that the model cars being displayed thereon look like they are participating in a race.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a schematic perspective view of a straightaway shelf unit and a curve shelf unit of a new display shelf according to the present invention.

FIG. 2 is a schematic side view of a straightaway shelf unit of the present invention.

DESCRIPTION OF THE PREFERRED EMBODIMENT

Figure 3:
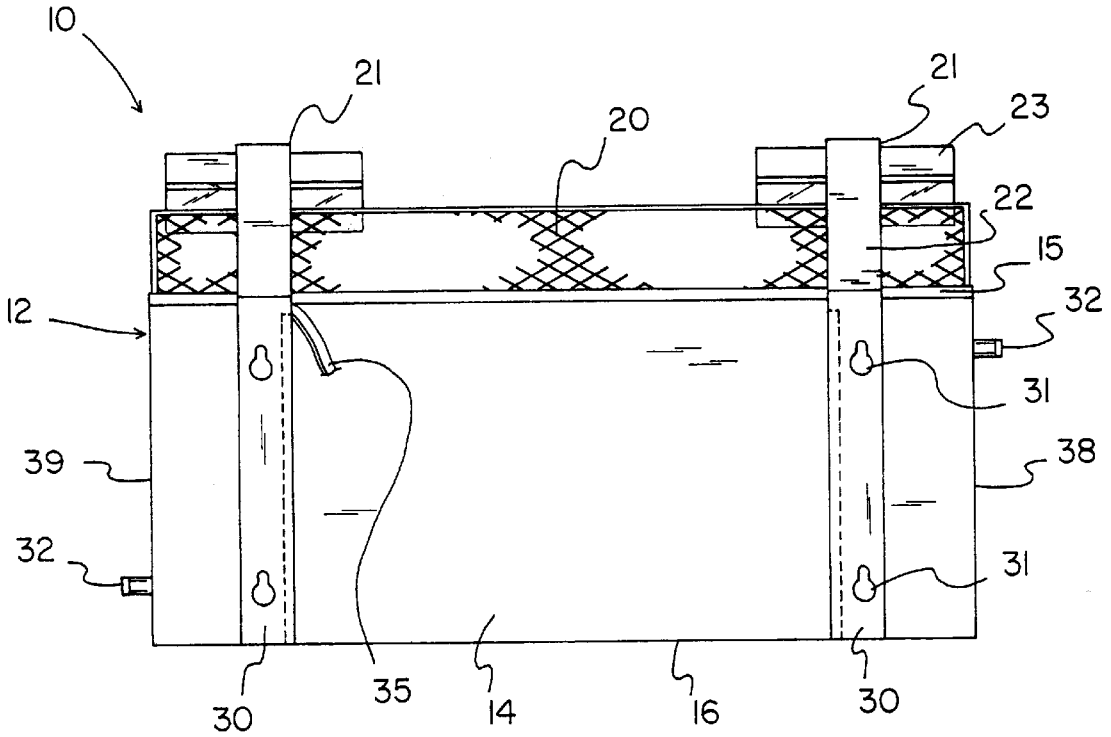
FIG. 3 is a schematic back side view of a straightaway shelf unit of the present invention.

With reference now to the drawings, and in particular to FIGS. 1 through 4 thereof, a new display shelf embodying the principles and concepts of the present invention and generally designated by the reference numeral 10 will be described.

As best illustrated in FIGS. 1 through 4, the display shelf 10 generally comprises at least one shelf unit 10 comprising a top panel 12 and a pair of support panels 24,25. The top panel 12 has upper and lower surfaces 13,14, top and bottom side edges 15,16, and a pair of end edges 38,39 extending between the side edges of the top panel 12. The upper surface 13 of the top panel 12 has a number of elongate ridges 17,18,19 upwardly extending therefrom with the length of each of the ridges extending between the end edges 38,39 of the top panel 12. Each support panel 24,25 is generally triangular and has top, bottom and back edges 26,27,28 with the length of the top edge 26 of the support panel extending at an acute angle to the length of the bottom edge 27 of the support panel. The top edge 26 of each of the support panels 24,25 is coupled to the lower surface 14 of the top panel 12. The back edge 28 of each of the support panels 24,25 has a mounting flange 30,31 extending therefrom which is positioned adjacent the top edge 26 of the top panel 12.

In use, the display shelf is designed for displaying model cars thereon and may include several shelf units. In closer detail, each shelf unit has a top panel 12 having upper and lower surfaces 13,14, a top and bottom side edges 15,16, and a pair of end edges 38,39 extending between the side edges of the top panel 12. The upper surface 13 of the top panel 12 is designed for resting model cars thereon. The upper surface 13 of the top panel 12 has a number of elongate ridges 17,18,19 upwardly extending therefrom. Each of the ridges has a length extending between the end edges 38,39 of the top panel 12. A first 17 of the ridges is positioned adjacent the top side edge 15 of the top panel 12 while a second 18 of the ridges is positioned adjacent the bottom side edge 16 of the top panel 12. A third 19 of the ridges is interposed midway between the first and second ridges. Preferably, the first and second ridges 17,18 are positioned about 1 inch from the adjacent side edge 15,16 of the top panel 12. In use, the first ridge is designed for hanging the tires from one side of a model car from while the second and third ridges 18,19 are designed for resting the tires of one the of a model car thereon such that three rows of model cars may be displayed on the upper surface 13 of the top panel 12.

Preferably, an elongate fencing member 20 is outwardly extended from the upper surface 13 of the top panel 12. The fencing member 20 is positioned adjacent the top side edge 15 of the top panel 12 with the length of the fencing member 20 extends between the end edges 38,39 of the top panel 12. The fencing member 20 is designed to resemble a guard fence around a auto race track. At least one lamp post member 21 is preferably coupled to the top side edge 15 of the top panel 12. The lamp post member 21 has a shaft portion 22 terminating at a head portion 23. The shaft portion 22 of the lamp post member 21 is outwardly extended from the upper surface 13 of the top panel 12 such that the head portion 23 of the lamp post member 21 is positioned over the upper surface 13 of the top panel 12. The head portion 23 of the lamp post member 21 has a light source which is designed for shining light on the upper surface 13 of the top panel 12. The light source is electrically connectable to a power source by an electric cord 35.

Each shelf unit also includes a pair of support panels 24,25. Each support panel is generally triangular and has top, bottom and back edges 26,27,28. The length of the back edge 28 of the support panel is preferably extended substantially perpendicular to the length of the bottom edge 27 of the support panel. The length of the top edge 26 of the support panel is extended at an acute angle to the length of the bottom edge 27 of the support panel. In an ideal embodiment, the acute angle is about 45 degrees. In another ideal embodiment, the acute angle is about 33 degrees.

Figure 4:
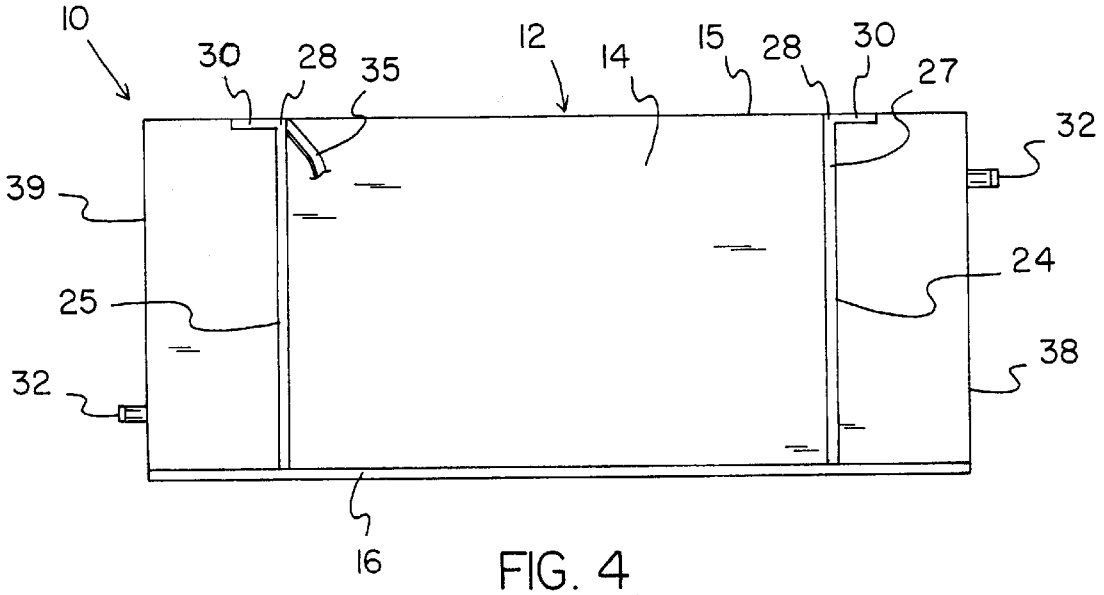
FIG. 4 is a schematic bottom side view of a straightaway shelf unit of the present invention.

The top edge 26 of each of the support panels 24,25 is coupled to the lower surface 14 of the top panel 12. One of the support panels is positioned towards one of the end edges of the top panel while the other support panel is positioned towards another of the end edges of the top panel. The back edge 28 of each of the support panels 24,25 has a mounting flange 29,30 extending therefrom. The mounting flanges 29,30 is designed for attachment to a support structure, such as a wall. The mounting flanges 29,30 are positioned adjacent the top edge 26 of the top panel 12. Preferably as illustrated in FIG. 4, each of the mounting flanges 29,30 is extended towards an adjacent end edge of the top panel 12. With reference to FIG. 3, each of the mounting flanges 29,30 has a pair of spaced apart keyhole mounting slots 31 therethrough. The mounting slots 31 are designed for extending fasteners therethrough to attach the mounting flanges 29,30 to a support structure.

Each of the end edges 38,39 of the top panel 12 has a connector such as plug and socket connectors 32,33. The connector is electrically connected to the light source of the lamp post member 21. The connectors are designed for connecting to a connector of another shelf unit to electrically connect the light sources of the shelf units together and to help hold the units together. FIG. 1 illustrates how a pair of shelf units are connected together. Power travels from one of the shelf units to the other via the plug and socket connectors, much like a regular electrical plug works, but with opposing prongs. The fit of the plugs into the sockets should be such that the shelf units are held together, much like a nightlight is held to an electrical socket by a pair of electrical prongs.

With reference to FIG. 1, ideally, the display shelf system includes modular straight away shelf units 10 and curve shelf units 34. The top panel 12 of a straightaway shelf unit 10 is generally rectangular such that the top and bottom side edges 15,16 of a straightaway shelf unit are generally straight. As illustrated in FIG. 1, the top and bottom side edges 15,16 of a curve shelf unit 34 are generally arcuate. In an ideal illustrative embodiment, the top panel 12 has a width defined between the top and bottom side edges 15,16 of about 13 inches. In this illustrative embodiment, the top panel 12 of a straightaway shelf unit has a length defined between the end edges 38,39 of the top panel 12 of about 3 feet.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A display shelf system, comprising:

at least one straightaway shelf unit and at least one curve shelf unit;

wherein each shelf unit comprises:

a top panel having upper and lower surfaces, a top and bottom side edges, and a pair of end edges extending between said side edges of said top panel;

said upper surface of said top panel having a number of elongate ridges upwardly extending therefrom, each of said ridges having a length extending between said end edges of said top panel; and a pair of support panels;

wherein said top panel of said straightaway shelf unit is generally rectangular such that said top and bottom side edges of said straightaway shelf unit arc generally straight, and wherein said top and bottom side edges of said curve shelf unit are generally arcuate.

2. The system of claim 1, wherein a first of said ridges of at least one of said shelf units is positioned adjacent said top side edge of said top panel of said shelf unit, a second of said ridges of said at least one of said shelf units is positioned adjacent said bottom side edge of said top panel of said shelf unit, and a third of ridges of said at least one of said shelf units is interposed between said first and second ridges of said shelf unit.

3. The system of claim 1, wherein at least one of said shelf units further comprises an elongate fencing member being outwardly extended from said upper surface of said top panel, said fencing member being positioned adjacent said top side edge of said top panel, said fencing member having a length extending between said end edges of said top panel.

4. The system of claim 1, wherein at least one of said shelf units further comprises at least one lamp post member being coupled to said top side edge of said top panel.

5. The system of claim 4, wherein said lamp post member of said at least one of said shelf units has a shaft portion terminating at a head portion, wherein said shaft portion of said lamp post member is outwardly extended from said upper surface of said top panel such that said head portion of said lamp post member is positioned over said upper surface of said top panel, wherein said head portion of said lamp post member has a light source, said light source of said head portion of said lamp post member being for shining light on said upper surface of said top panel.

6. The system of claim 5, wherein each of said end edges of said top panel of said at least one of said shelf units has a connector, said connector being electrically connected to said light source of said lamp post member of said shelf unit, said connector being for connecting to a connector of another shelf unit to electrically connect the light sources of the shelf units together.

7. The system of claim 1, wherein each of said mounting flanges of at least one of said shelf units has a pair of spaced apart mounting slots therethrough.

8. A display shelf system comprising:

a straightaway shelf unit and a curve shelf unit;

wherein each shelf unit comprises:

a top panel having upper and lower surfaces, a top and bottom side edges, and a pair of end edges extending between said side edges of said top panel;

said upper surface of said top panel having a number of elongate ridges upwardly extending therefrom, each of said ridges having a length extending between said end edges of said top panel;

a pair of support panels;

each support panel being generally triangular and having top, bottom and back edges the length of said top edge of said support panel being extended at an acute angle to the length of said bottom edge of said support panel;

said top edge of each of said support panels being coupled to said lower surface of said top panel; and said back edge of each of said support panels having a mounting flange extending therefrom, said mounting flanges being positioned adjacent said top edge of said top panel; and wherein said top panel of a straightaway shelf unit is generally rectangular such that said top and bottom side edges of a straightaway shelf unit are generally straight, and wherein said top and bottom side edges of a curve shelf unit are generally arcuate.

9. A display shelf system, comprising:

a straightaway shelf unit and a curve shelf unit;

wherein each shelf unit comprises:

a top panel having upper and lower surfaces, a top and bottom side edges, and a pair of end edges extending between said side edges of said top panel;

said upper surface of said top panel having a number of elongate ridges upwardly extending therefrom, each of said ridges having a length extending between said end edges of said top panel;

a first of said ridges being positioned adjacent said top side edge of said top panel, a second of said ridges being positioned adjacent said bottom side edge of said top panel, a third of said ridges being interposed between said first and second ridges;

an elongate fencing member being outwardly extended from said upper surface of said top panel, said fencing member being positioned adjacent said top side edge of said top panel, said fencing member having a length extending between said end edges of said top panel;

at least one lamp post member being coupled to said top side edge of said top panel;

said lamp post member having a shaft portion terminating at a head portion, said shaft portion of said lamp post member being outwardly extended from said upper surface of said top panel such that said head portion of said lamp post member is positioned over said upper surface of said top panel;

said head portion of said lamp post member having a light source, said light source of said head portion of said lamp post member being for shining light on said upper surface of said top panel, said light source being electrically connectable to a power source;

a pair of support panels;

each support panel being generally triangular and having top, bottom and back edges, the length of said top edge of said support panel being extended at an acute angle to the length of said bottom edge of said support panel, the length of said back edge of said support panel being extended substantially perpendicular to said length of said bottom edge of said support panel;

said top edge of each of said support panels being coupled to said lower surface of said top panel;

one of said support panels being positioned towards one of said end edges of said top panel, another of said support panels being positioned towards another of said end edges of said top panel;

said back edge of each of said support panels having a mounting flange extending therefrom, said mounting flanges being positioned adjacent said top edge of said top panel, each of said mounting flanges being extended towards an adjacent end edge of said top panel;

each of said mounting flanges having a pair of spaced apart mounting slots therethrough; and each of said end edges of said top panel having a connector, said connector being electrically connected to said light source of said lamp post member, said connector being for connecting to a connector of another shelf unit to electrically connect the light sources of the shelf units together;

wherein said top panel of said straightaway shelf unit is generally rectangular such that said top and bottom side edges of said straightaway shelf unit are generally straight; and wherein said top and bottom side edges of said curve shelf unit are generally arcuate.

* * * * *